US007005790B2

(12) United States Patent
Kyono et al.

(10) Patent No.: US 7,005,790 B2
(45) Date of Patent: Feb. 28, 2006

(54) GLASS FUNNEL FOR CATHODE-RAY TUBE AND GLASS BULB FOR CATHODE-RAY TUBE

(75) Inventors: Masaya Kyono, Otsu (JP); Hiroshi Kakigi, Otsu (JP)

(73) Assignee: Nippon Electric Glass Co., Ltd., Shiga-Ken (JP)

( * ) Notice: Subject to any disclaimer, the term of this patent is extended or adjusted under 35 U.S.C. 154(b) by 225 days.

(21) Appl. No.: 10/399,761

(22) PCT Filed: Dec. 7, 2001

(86) PCT No.: PCT/JP01/10758

§ 371 (c)(1),
(2), (4) Date: Sep. 8, 2003

(87) PCT Pub. No.: WO02/47107

PCT Pub. Date: Jun. 13, 2002

(65) Prior Publication Data

US 2004/0027045 A1 Feb. 12, 2004

(30) Foreign Application Priority Data

Dec. 7, 2000 (JP) ..... 2000-373315

(51) Int. Cl.
*H01J 31/00* (2006.01)
*H01J 29/86* (2006.01)

(52) U.S. Cl. ..... 313/477 R; 220/2.1 R; 220/2.1 A

(58) Field of Classification Search ..... 313/477 R, 313/461; 220/2.1 A, 2.3 A, 2.3 R, 2.1 R; 348/823

See application file for complete search history.

(56) References Cited

U.S. PATENT DOCUMENTS

| | | | | |
|---|---|---|---|---|
| 4,030,627 | A * | 6/1977 | Lentz | 220/2.1 A |
| 4,483,452 | A | 11/1984 | Blanding et al. | 220/2.1 |
| 4,686,415 | A * | 8/1987 | Strauss | 313/402 |
| 6,680,567 | B1 * | 1/2004 | Sugawara et al. | 313/477 R |
| 2003/0025439 | A1 | 2/2003 | Fujita | 313/477 |

FOREIGN PATENT DOCUMENTS

| | | |
|---|---|---|
| JP | 49-123262 | 3/1973 |
| JP | 59-189541 | 10/1984 |
| JP | 63-102144 | 5/1988 |
| JP | 63-250046 | 10/1988 |
| JP | 3-103548 | 10/1991 |
| JP | 03-236142 | 10/1991 |
| JP | 07-320661 | 8/1995 |

* cited by examiner

*Primary Examiner*—Karabi Guharay
(74) *Attorney, Agent, or Firm*—J.C. Patents

(57) ABSTRACT

A body portion of the funnel, within a range excluding corners, has a first region of predetermined dimension, the predetermined dimension being measured from the seal edge surface in a direction parallel to a tube axis, and a second region excluding the first region. The second region has a thickness relatively smaller than the thickness of the first region, so that a boundary portion between the two regions forms a stepped portion on the external surface of the body portion.

14 Claims, 15 Drawing Sheets

(minor-axis section)

(major-axis section)

(diagonal-axis section)

GLASS FUNNEL FOR CATHODE-RAY TUBE AND GLASS BULB FOR CATHODE-RAY TUBE

BACKGROUND OF THE INVENTION

The invention relates to a glass funnel and a glass bulb for a cathode-ray tube for use in television reception or the like.

As shown in FIG. 13, for example, a glass bulb 11 for constituting a cathode-ray tube for use in television reception or the like comprises a glass panel (hereinafter, referred to as "panel") 12 on which images are displayed, a glass funnel (hereinafter, referred to as "funnel") 13 having the shape of a funnel which forms the back thereof, and a neck portion 14 in which, an electron gun is installed. The neck portion 14 is fusion bonded to a smaller opening portion of the funnel 13. The panel 12 has a face portion 12*a* which makes an image viewing area and a skirt portion 12*b* which extends generally perpendicularly from the periphery of the face portion 12*a*. As shown enlarged in FIG. 14, a seal edge surface 12*b*1 arranged on the end surface of the skirt portion 12*b* and a seal edge surface 13*c*1 arranged on a larger opening portion of the funnel 13 are joined to each other through a seal glass 15 for sealing.

The glass bulb 11 for a cathode-ray tube, formed as described above, is used as a vacuum vessel after installing an electron gun in the neck portion 14 and then evacuating inside thereof (the internal pressure after the evacuation is on the order of, e.g., $10^{-8}$ Torr). Consequently, the external surface of the glass bulb 11 undergoes a stress caused by the load of the atmospheric pressure (hereinafter, this stress will be referred to as "vacuum stress"). It is required that the glass bulb 11 has mechanical and structural strengths sufficient to resist a fracture resulting from this vacuum stress (vacuum fracture). That is, if these strengths are insufficient, the glass bulb 11 may cause fatigue fracture since it cannot endure the vacuum stress. In addition, if accompanied with such foreign factors as minute flaws on the external surface or the application of an impact load, the fatigue fracture is expected to proceed faster. Besides, in the step of fabricating the cathode-ray tube, the glass bulb 11 is raised to around 400° C. in temperature. The thermal stress resulting from the temperature rise and the vacuum stress may produce a synergistic effect toward fracture.

Since the glass bulb 11 is aspheric, the vacuum stress acts on the glass bulb 11 as compressive stress and tensile stress. These stresses have general distributions as shown in FIG. 15. Here, FIGS. 15(*a*), (*b*), and (*c*) show stress distributions in a minor-axis section, a major-axis section, and a diagonal-axis section, respectively. In these stress distribution diagrams, the regions indicated with inward arrows represent regions undergoing compressive stress, and the regions indicated with outward arrows regions undergoing tensile stress.

Glass structures are generally weaker to tensile stress than to compressive stress in fracture strength. In the glass bulb 11 for a cathode-ray tube, as a vacuum vessel, a fracture is easy to progress originating with the regions undergoing tensile stress that results from the vacuum stress (hereinafter, this stress will be referred to as "tensile vacuum stress"), namely, the regions extending from the periphery of the face portion 12*a* to the skirt portion 12*b* of the panel 12 and the regions around the seal edge surface 13*c*1 of the funnel 13. In particular, the seal edge surface 12*b*1 of the panel 12 and the seal edge surface 13*c*1 of the funnel 13 are joined through the seal glass 15 for sealing. Since this joint portion is a weak point in strength while the tensile vacuum stress peaks in the vicinity of the joint portion {FIGS. 15(*a*) and (*b*)}, preventive measures against the fracture originating with the joint portion are of importance. For such reasons, the conventional glass bulb 11 for a cathode-ray tube has been increased in thickness to secure necessary fracture strength.

Recently, flatter or larger screens are required to displays for television reception and the like. Based on this, cathode-ray tubes are also on the way to flattening or planarization. Accordingly, glass bulbs for a cathode-ray tube are getting farther from being spherical in shape than ever before, and the vacuum stress distribution is increasing in the degree of unevenness. Thus, the strength level required to the glass bulbs for a cathode-ray tube grows in severity. This results in a further increase in the thickness of the glass bulbs for a cathode-ray tube, accompanied with an increase in weight. The increase in the weight of the glass bulbs for a cathode-ray tube not only imposes an inconvenience on transportation, handling, and the like, but also causes an increase in the weight of the final products incorporating the cathode-ray tubes, thereby causing lower commercial values. In particular, large-sized glass bulbs for a cathode-ray tube are more prone to that tendency.

Under the foregoing circumstances, a weight reduction is desired of glass bulbs for a cathode-ray tube. Meanwhile, it is also important to secure strength sufficient to resist vacuum fracture since the flattening or planarization of the cathode-ray tubes has increased the degree of unevenness of the vacuum stress acting on the glass bulbs for a cathode-ray tube.

SUMMARY OF THE INVENTION

It is an object of the present invention to provide a glass funnel for a cathode-ray tube which is light in weight and capable of securing strength sufficient to resist fracture resulting from vacuum stress when constituting a cathode-ray tube.

Another object of the present invention is to provide, in a glass bulb for a cathode-ray tube having a glass panel for a cathode-ray tube which is substantially flat at an external surface of a face portion thereof, a constitution which can achieve a reduction in weight and secure strength sufficient to resist fracture resulting from vacuum stress.

Still another object of the present invention is to provide a glass funnel for a cathode-ray tube having excellent moldability.

To achieve the foregoing objects, the present invention provides a glass funnel for a cathode-ray tube, having a shape of a funnel with a rectangular larger opening portion at one end and a smaller opening portion at the other end, the larger opening portion being composed of major sides across a minor axis, minor sides across a major axis, and corners on a diagonal axis, the corners continuing between the major sides and the minor sides, the glass funnel comprising a seal edge portion extending from a seal edge surface of the larger opening portion to a mold match line, a yoke portion to be equipped with a deflection yoke, the yoke portion being arranged at a side of the smaller opening portion, and a body portion for continuing between the mold match line and the yoke portion. In the constitution, the seal edge surface has a thickness almost equal to a thickness of a seal edge surface of a glass panel for a cathode-ray tube to be joined thereto. The body portion, within a range excluding the corners, has a first region of predetermined dimension, the predetermined dimension being measured from the seal edge surface in a direction parallel to a tube axis, and a second portion excluding the first portion. When constituting a cathode-ray tube, the first region falls on a region to undergo tensile vacuum stress resulting from a vacuum pressure in the cathode-ray tube. The second region has a thickness smaller than a thickness of the first region, so that a boundary portion between the first region and the second region forms a stepped portion on an external surface of the body portion.

Here, as, shown in FIG. 12, the "mold match line" refers to a mold matching plane 3*c*2 between a bottom mold 21 (a mold having a molding surface of funnel shape for molding the portions except the seal edge portion 3*c*) and a shell mold 22 (a mold of generally rectangular annular shape to be placed in position on and combined with the bottom mold 21 to mold the seal edge portion 3*c* precisely) which constitute a female mold out of the molds used in press-molding the glass funnel 3 for a cathode-ray tube. A gob of molten glass (glass gob) is supplied into the female mold constituted by the bottom mold 21 and the shell mold 22, then a plunger 23 as a male mold is pressed into the female mold to extend the glass gob along the molding surfaces of the female and male molds under pressure. Thus, the glass funnel 3 for a cathode-ray tube is molded.

According to the glass funnel for a cathode-ray tube as mentioned above, since the seal edge surface thereof has the thickness S almost equal to the thickness of the seal edge surface of the glass panel for a cathode-ray tube, a joint area between the two seal edge surfaces is sufficiently secured so that the joint with the seal glass for sealing or the like can be easily firmly performed. Consequently, the joint portion of the panel and the funnel can secure sufficient strength.

Moreover, the body portion, within a range excluding the corners, is divided into the first region of predetermined dimension measured from the seal edge surface in the direction parallel to the tube axis and the second region excluding the first region. The two regions are given different thicknesses from each other. That is, the thickness of the second region is rendered relatively smaller than the thickness of the first region.

As stated previously, the tensile vacuum stress in the conventional glass bulb for a cathode-ray tube peaks in the vicinity of the joint portion between the panel and the funnel on the major sides and the minor sides {FIGS. 15(*a*) and (*b*)}. In contrast, according to the glass funnel for a cathode-ray tube of the present invention, the body portion is given the foregoing constitution so that the first region having a relatively greater thickness is arranged at the side of the seal edge portion and the second portion having a relatively smaller thickness is arranged at the side of the smaller opening portion. Consequently, when constituting the cathode-ray tube, the peaks of the tensile vacuum stress on the major sides and the minor sides shift toward the side of the smaller opening portion (toward the side of the neck portion) from the vicinity of the joint portion between the panel and the funnel (see FIG. 10 to be described later). As a result, the tensile vacuum stress acting on the joint portion, which is a weak point in strength, is relieved and the strength against vacuum fracture is further improved. In addition, the provision of the second region having a relatively smaller thickness allows a weight reduction of the glass funnel for a cathode-ray tube.

Since the first region and the second region are given different thicknesses for the reason mentioned above, the boundary portion between the two regions forms the stepped portion on the external surface of the body portion. Nevertheless, if the stepped portion lies over the entire circumference of the body portion, there is fear that the moldability in press-molding the glass funnel for a cathode-ray tube may be hampered. More specifically, when a gob of molten glass (glass gob) is extended along the molding surfaces of the female and male molds under pressure, in the diagonal-axis directions, the molten glass is extended as making detours from the minor-axis sides and the major-axis sides. On that account, the presence of the stepped portion in the corners can increase the press-extending resistance of the molten glass at the portions, thereby delaying the time to fill up the seal edge portion as compared to the minor-axis sides and the major-axis sides. As a result, the molten glass filled into the seal edge portion at the corners decreases in temperature, sometimes causing such problems as minute cracks in the glass or an increase in the pressing force. Thus, in terms of moldability, the stepped portion is preferably absent at the corners.

Moreover, with reference to the vacuum stress distributions shown in FIG. 15, tensile vacuum stress in the vicinity of the joint portion peaks on the major sides {minor-axis section of FIG. 15(*a*)}, becomes relatively smaller on the minor sides than on the major sides {major-axis section of FIG. 15(*b*)}, and occurs little or becomes considerably smaller at the corners than on the minor sides and the major sides {diagonal-axis section of FIG. 15(*c*)}. Hence, as compared to the minor sides and the major sides, the corners have less necessity to take the effect of tensile vacuum stress into account.

In view of the foregoing, in the present invention, the first portion and the second portion are arranged within the range excluding the corners so that the stepped portion is not formed at the corners. This can eliminate the foregoing fear in molding and thereby enhance the moldability of the glass funnel for a cathode-ray tube. The second region and the corners are preferably rendered continuous without any step.

In the foregoing constitution, the end points of the stepped portion may be set on the boundaries of the minor sides and the major sides with the corners, or may be shifted toward the major axis and the minor axis from the boundaries. To put it in terms of a 90°-range quadrant including the minor axis and the major axis, the stepped portion may be arranged within a range from the minor axis to a distance Xs along the major side and a range from the major axis to a distance Ys along the minor side. In the configuration, the distance Xs (end point) satisfies $Xs \leqq Xo$ and the distance Ys (end point) satisfies $Y_s \leqq Yo$, where Xo is a distance from the minor axis to the boundary between the major side and the corner and Yo is a distance from the major axis to the boundary between the minor side and the corner.

Now, if the distances Xs and Ys are too small, the range available for the second region decrease so much that the weight reduction of the glass funnel for a cathode-ray tube and the effect of relieving the tensile vacuum stress acting on the joint portion become insufficient. Generally, in this type of glass funnel for a cathode-ray tube, alignment reference portions intended for contact with a fixture to achieve alignment during the joint to the panel are arranged on the respective external surfaces of the minor sides and the major sides, so that the panel and the neck portion can be assembled in precise axis alignment to allow proper image display of the cathode-ray tube without color shift or the like. The distance Xs is preferably set within $Xr/2 \leqq Xs \leqq Xo$ and the distance Ys within $Yr/2 \leqq Ys \leqq Yo$, where Xr is a distance from the minor axis to the center of the alignment reference portion on the major side and Yr is a distance from the major axis to the center of the alignment reference portion on the minor side. This can ensure the foregoing effects.

Moreover, if the stepped portion has too small a step, the reduction in the thickness of the second region becomes insufficient, failing to achieve a weight reduction of the glass funnel for a cathode-ray tube and the effect of relieving the tensile vacuum stress acting on the joint portion sufficiently. On the contrary, if the step of the stepped portion is excessively great, the second region becomes too small in thickness, thus lacking mechanical and structural strengths thereof. With the viewpoint of achieving a weight reduction of the glass funnel for a cathode-ray tube and the effect of relieving the vacuum stress acting on the joint portion sufficiently, and securing desired strength, a maximum step $\Delta Tmax$ of the stepped portion is favorably set to fall within the range of $0.06 \leqq \Delta Tmax/S \leqq 0.3$, and preferably $0.06 \leqq \Delta Tmax/S \leqq 0.2$, with respect to the thickness S of the seal edge surface.

Moreover, the stepped portion may have the same step on the minor sides and the major sides, whereas a maximum step $\Delta TLmax$ on the major sides and a maximum step $\Delta TSmax$ on the minor sides, considering that the tensile vacuum stress peaks on the major sides {minor-axis section of FIG. 15(*a*)} and becomes relatively smaller on the minor sides than on the major sides {major-axis section of FIG. 15(*b*)} as mentioned above, may be given a relationship that $\Delta TLmax \leqq \Delta TSmax$.

To relieve sudden changes in thickness at the end points of the stepped portion, the stepped portion may also be provided with connecting portions which lead to a position of distance Xs (end point) and a position of distance Ys (end point), respectively, while gradually decreasing in step.

To achieve the foregoing objects, the present invention also provides a glass funnel for a cathode-ray tube, having a shape of a funnel with a rectangular larger opening portion at one end and a smaller opening portion at the other end, the larger opening portion being composed of major sides across a minor axis, minor sides across a major axis, and corners on a diagonal axis, the corners continuing between the major sides and minor sides, the glass funnel comprising a seal edge portion extending from a seal edge surface of the larger opening portion to a mold match line, a yoke portion to be equipped with a deflection yoke, the yoke portion being arranged at a side of the smaller opening portion, and a body portion for continuing between the mold match line and the yoke portion. In the configuration, the seal edge surface has a thickness almost equal to the thickness of a seal edge surface of a glass panel for a cathode-ray tube to be joined thereto. The body portion has a first region of predetermined dimension measured from the seal edge surface in a direction parallel to a tube axis and a second portion excluding the first portion. When constituting a cathode-ray tube, the first region falls on a region to undergo tensile vacuum stress resulting from a vacuum pressure in the cathode-ray tube. The second region has a thickness smaller than a thickness of the first region, so that a boundary portion between the first region and the second region forms a stepped portion on an external surface of the body portion. A maximum step $\Delta TLmax$ of the stepped portion on the major sides and a maximum step $\Delta TSmax$ of the stepped portion on the minor sides have a relationship that $\Delta TSmax \leqq \Delta TLmax$. This invention is one in which $\Delta TSmax \leqq \Delta TLmax$ is established for the reason mentioned above. This invention covers both the configuration that the first region and second region are arranged within a range excluding the corners and the configuration that the first region and second region are arranged over the entire circumference of the body portion including the corners.

To achieve the foregoing objects, the present invention also provides a glass bulb for a cathode-ray tube comprising: a glass panel for a cathode-ray tube including a face portion having a substantially flat external surface, a skirt portion extending from the periphery of the face portion, and a seal edge surface arranged on an end surface of the skirt portion; the glass funnel for a cathode-ray tube having a constitution described above; and a neck portion in which an electron gun is installed, the neck portion being joined to the smaller opening portion of the glass funnel for a cathode-ray tube, wherein the seal edge surface of the glass panel for a cathode-ray tube and the seal edge surface of the glass funnel for a cathode-ray tube are joined to each other.

Here, "substantially flat" means that the external surface of the face portion has a generatrix of 10000 mm or greater in the radius of curvature along the diagonal axis.

As stated previously, glass bulbs for a cathode-ray tube having a glass panel for a cathode-ray tube in which an external surface of a face portion is substantially flat tend to have greater weights in relation to strength. According to the glass bulb for a cathode-ray tube of the present invention, the contradictory characteristics of strength and light weight can be provided in favorable balance because of the effect related to the glass funnel for a cathode-ray tube described above.

According to the present invention, it is possible to provide a glass funnel for a cathode-ray tube which is light in weight and capable of securing strength sufficient to resist vacuum fracture when constituting a cathode-ray tube.

According to the present invention, it is also possible to achieve a reduction in weight and secure strength sufficient to resist vacuum fracture in a glass bulb for a cathode-ray tube having a glass panel for a cathode-ray tube in which an external surface of a face portion is substantially flat.

Furthermore, according to the present invention, it is possible to provide a glass funnel for a cathode-ray tube having excellent moldability.

DETAILED DESCRIPTION OF THE PREFERRED EMBODIMENTS

Hereinafter, embodiments of the present invention will be described with reference to the drawings.

Figure 1:
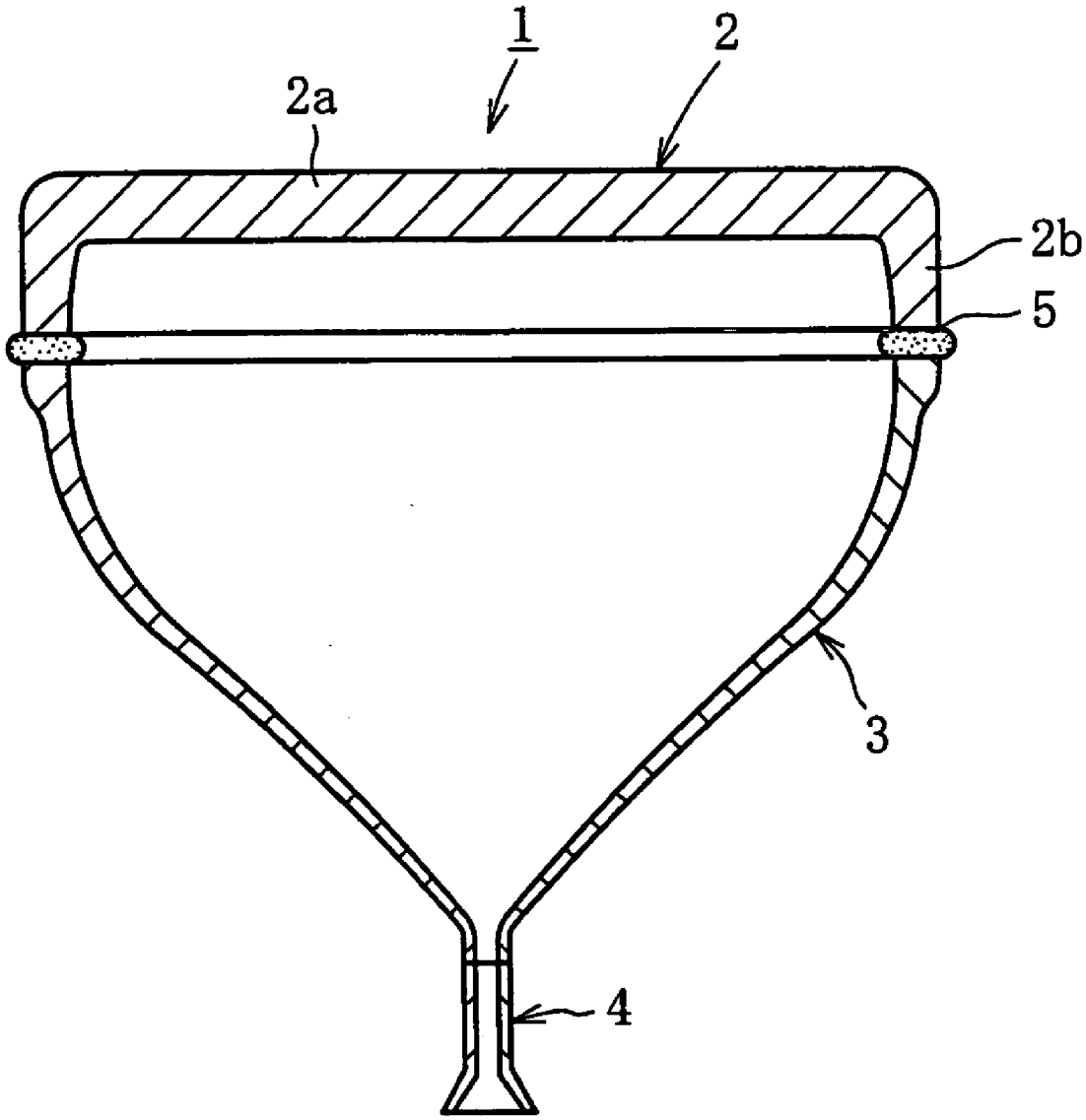
FIG. 1 is a sectional view of a glass bulb according to an embodiment, taken along a direction parallel to the tube axis.

FIG. 1 shows a glass bulb 1 for a cathode-ray tube according to an embodiment. The glass bulb 1 constitutes a cathode-ray tube for use in television reception or the like, and comprises a glass panel (hereinafter, referred to as "panel") 2 on which images are projected, a glass funnel (hereinafter, referred to as "funnel") 3 having the shape of a funnel which forms the back, and a, neck portion 4 to be equipped with an electron gun.

Figure 2:
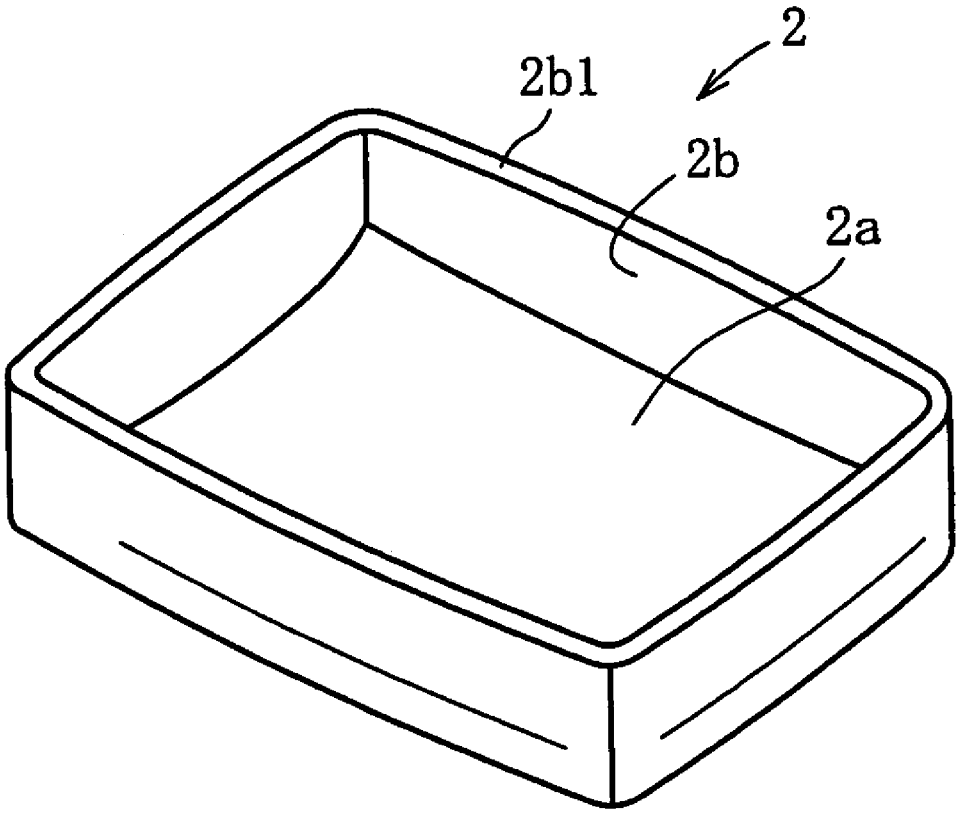
FIG. 2 is a perspective view of a panel according the embodiment.

The panel 2 has a rectangular face portion 2*a* which makes an image viewing area and a skirt portion 2*b* which extends generally perpendicularly from the periphery of the face portion 2*a*. As shown in FIG. 2, a seal edge surface 2*b*1 is arranged on the end surface of the skirt portion 2*b*. The external surface of the face portion 2*a* has a generatrix of 10000 mm or greater in the radius of curvature along the diagonal axis, forming a substantially flat surface.

Figure 3:
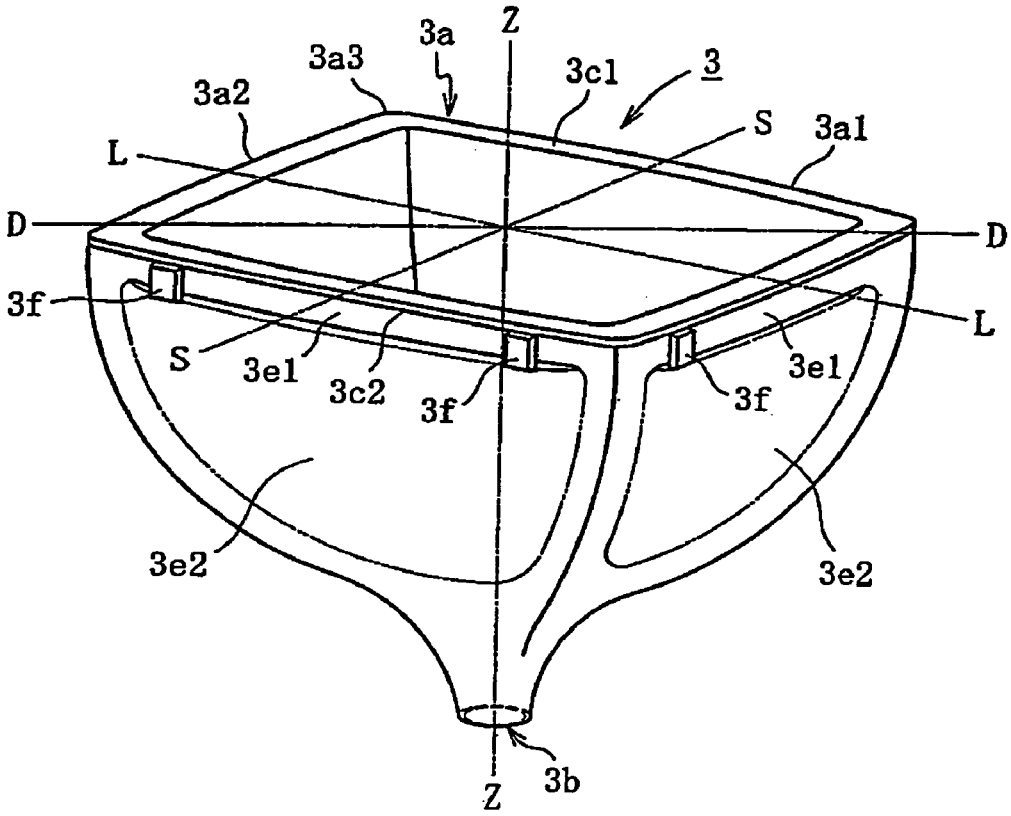
FIG. 3 is a perspective view of a funnel according the embodiment.
Figure 4:
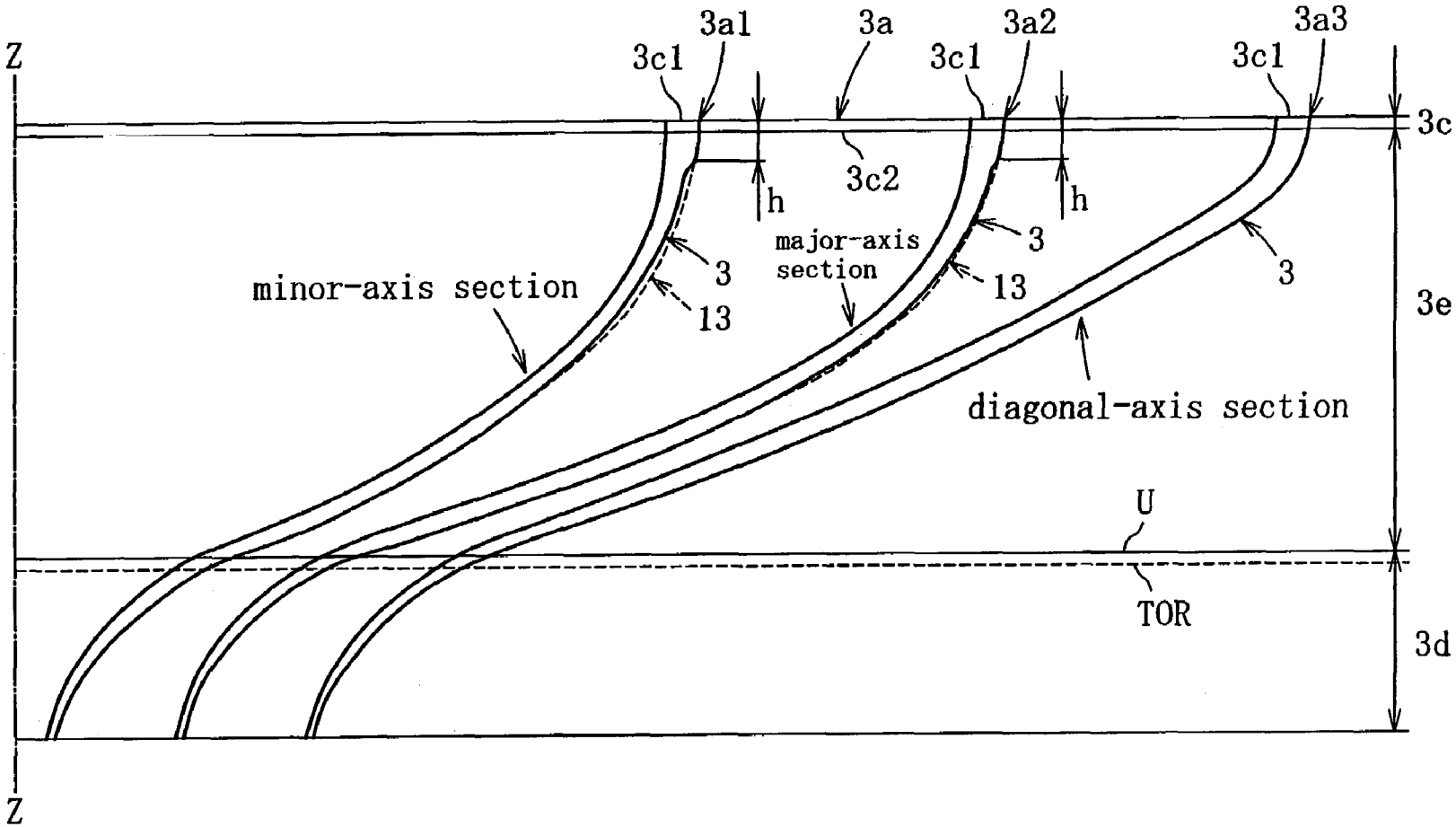
FIG. 4 is a partial sectional view of the funnel, taken along a direction parallel to the tube axis.

As shown in FIGS. 3 and 4, the funnel 3 has the shape of a funnel with a larger opening portion 3*a* at one end and a smaller opening portion 3*b* at the other end. The funnel 3 comprises a seal edge portion 3*c* which extends from a seal edge surface 3*c*1 of the larger opening portion 3*a* to a mold match line 3*c*2, a yoke portion 3*d* which is arranged at the side of the smaller opening portion 3*b* and to be equipped with a deflection yoke, and a body portion 3*e* for constituting between the mold match line 3*c*2 and the yoke portion 3*d*. The neck portion 4 is fusion bonded to the smaller opening portion 3*b* of the funnel 3. Here, the body portion 3*e* and the yoke portion 3*d* are continuous to each other across an interface U which is perpendicular to a tube, axis Z and passes through a position to be the inflection point of the shape of the external surface. The interface U typically lies slightly closer to the larger opening portion 3*a* than TOR (Top Of Round: a starting position from which a circular sectional shape on the side of the smaller opening portion 3*b* gradually changes into a rectangular sectional shape on the side of the larger opening portion 3*a*).

As shown in FIG. 3, the larger opening portion 3*a* is rectangular in shape, and comprises major sides 3*a*1 across a minor axis S, minor sides 3*a*2 across a major axis L, and corners 3*a*3 on diagonal axes D, the corners 3*a*3 continuing between the major sides 3*a*1 and the minor sides 3*a*2. Moreover, alignment reference portions 3*f* are formed on the respective external surfaces of the major sides 3*a*1 and the minor sides 3*a*2. These alignment reference portions 3*f* are intended for contact with a fixture to achieve alignment during the joint to the panel 2.

As shown in FIG. 1, the panel 2 and the funnel 3 fusion bonded with the neck portion 4 are fusion bonded to each other at their respective seal edge surfaces 2*b*1 and 3*c*1 through a seal glass 5 for sealing. The glass bulb 1 is thereby formed as a vacuum vessel.

Figure 5:
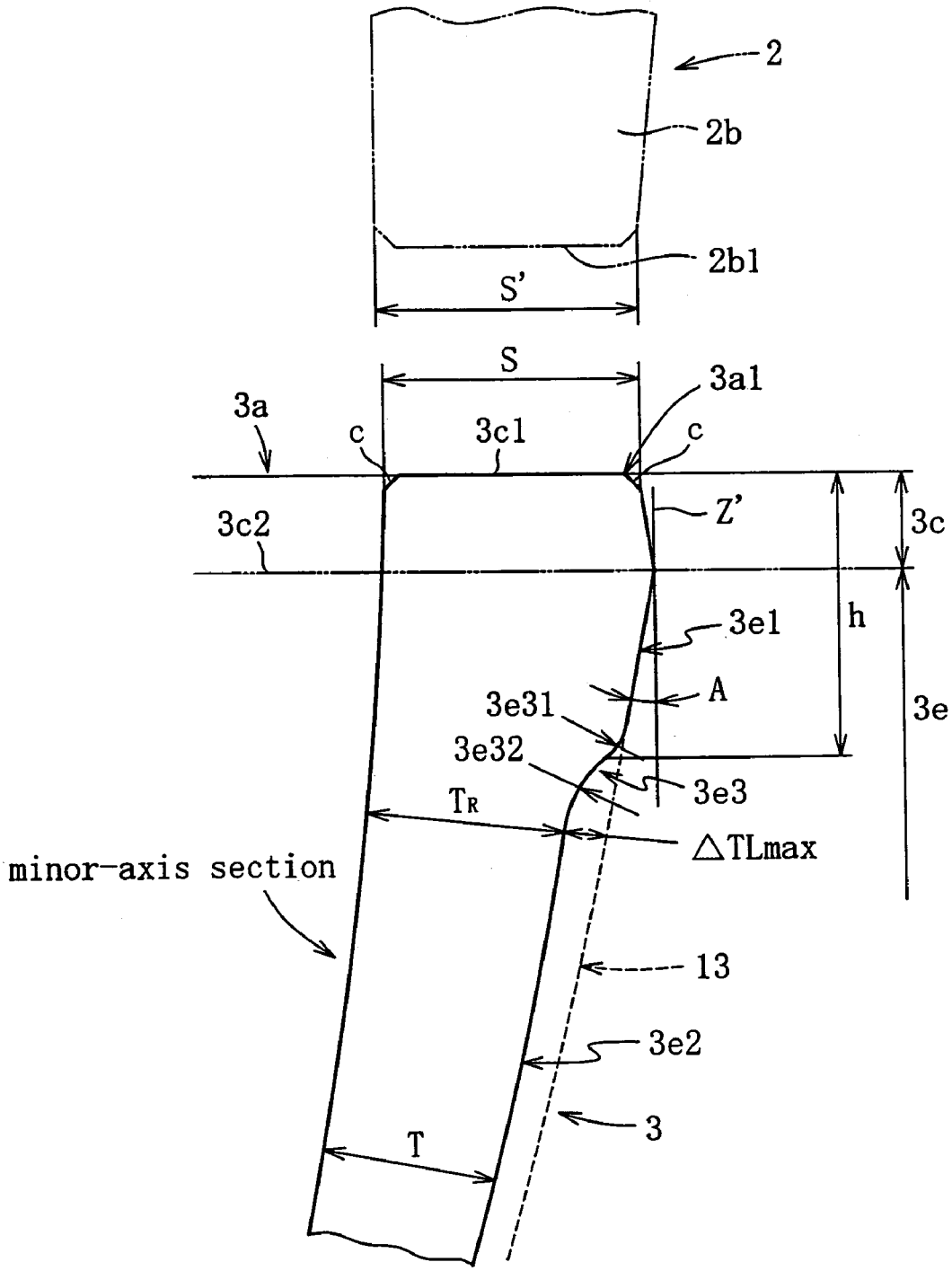
FIG. 5 is an enlarged partial sectional view showing the vicinity of the larger opening portion of the funnel.
Figure 6:
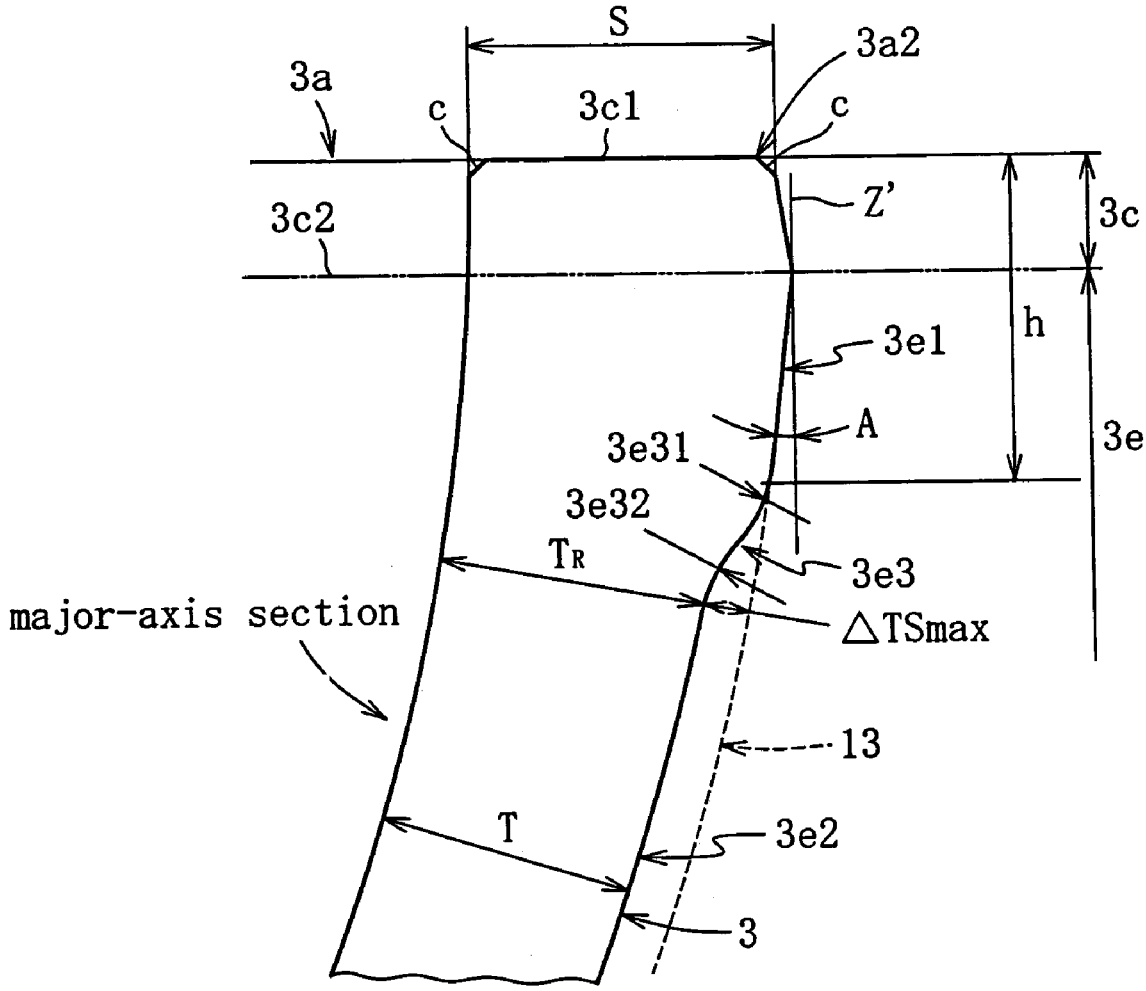
FIG. 6 is an enlarged partial sectional view showing the vicinity of the larger opening portion of the funnel.
Figure 7:
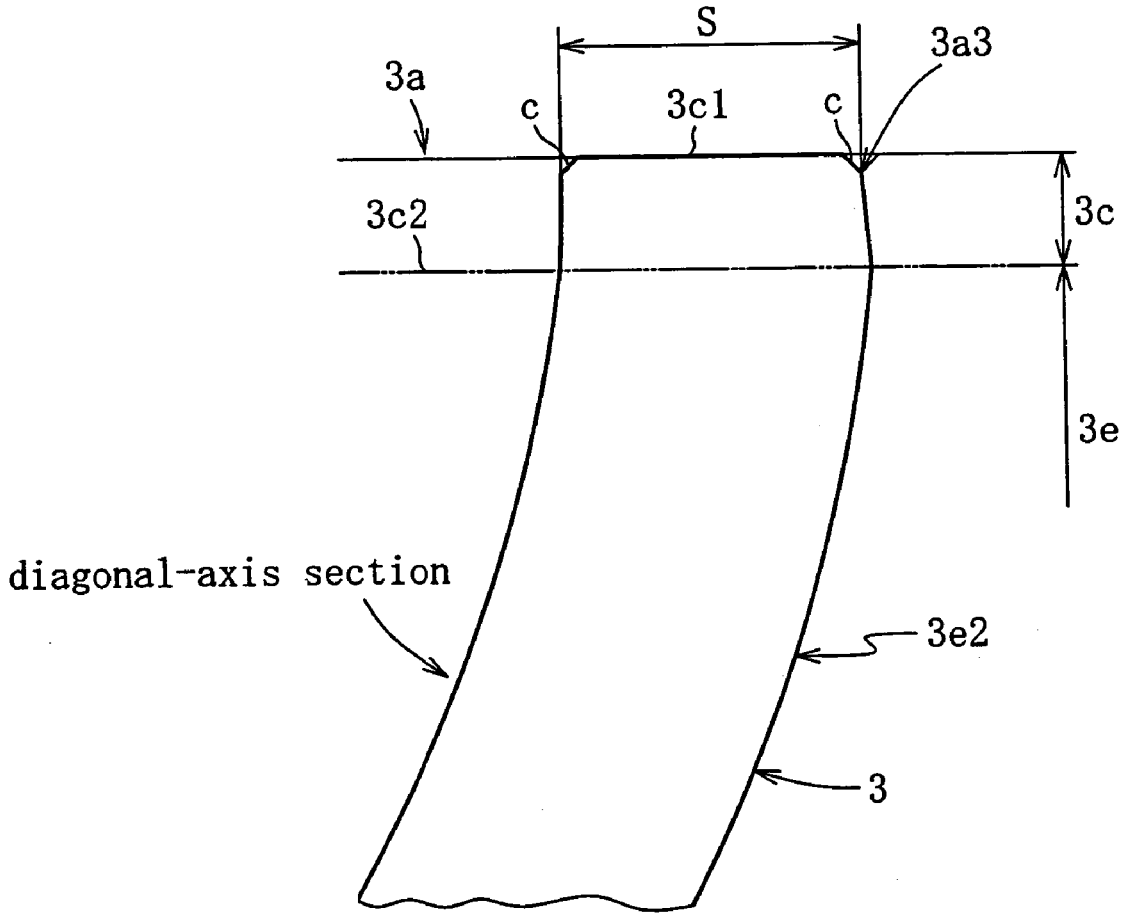
FIG. 7 is an enlarged partial sectional view showing the vicinity of the larger opening portion of the funnel.

FIGS. 5–7 show the vicinity of the larger opening portion 3*a* of the funnel 3 respectively. FIG. 5 shows a minor-axis section, FIG. 6 shows a major-axis section, and FIG. 7 shows a diagonal-axis section.

The thickness S of the seal edge surface 3*c*1 is set to be almost equal to the thickness S' of the seal edge surface 2*b*1 of the panel 2. This secures a sufficient joint area between the two seal edge surfaces 2*b*1 and 3*c*1, thereby allowing easy and firm joint with the seal glass 5 for sealing. Here, the thickness S of the seal edge surface 3*c*1, if the edges of the larger opening portion 3*a* are given chamfers C (or roundings formed in molding), refers to the dimension including the dimensions of the chamfers C (or roundings) in the direction of thickness. The same holds true for the seal edge surface 2*b*1 of the panel 2.

The body portion 3*e*, within a rage excluding the corners 3*a*3, has a first region 3*e*1 of predetermined dimension, the predetermined dimension being measured from the seal edge surface 3*c*1 in a direction parallel to the tube axis Z, and a second region 3*e*2 excluding the first region 3*e*1. The second region 3*e*2 has a thickness relatively smaller than the thickness of the first region 3*e*1, so that a boundary portion between the two regions forms a stepped portion 3*e*3 on the external surface of the body portion 3*e*.

The maximum dimension h of the first region 3*e*1 in the direction parallel to the tube axis Z is set within the range of, e.g., $0.5 \leqq h/S \leqq 1.5$ with respect to the thickness S of the seal edge surface 3*c*1. When the funnel 3 constitutes a cathode-ray tube accompanying with the panel 2, the first region 3*e*1 falls on a region to undergo tensile vacuum stress resulting from the vacuum pressure in the cathode-ray tube (see FIG. 10). In addition, for the step ΔT of the stepped portion 3*e*3, the maximum step ΔTLmax on the major side 3*a*1 (FIG. 5) and the maximum step ΔTSmax on the minor side 3*a*2 (FIG. 6), are set within the ranges of, e.g., $0.06 \leqq \Delta TLmax/S \leqq 0.3$ and $0.06 \leqq \Delta TSmax/S \leqq 0.3$, and preferably $0.06 \leqq \Delta TLmax/S \leqq 0.2$ and $0.06 \leqq \Delta TSmax/S \leqq 0.2$, with respect to the thickness S of the seal edge surface 3*c*1, respectively. In this case, the maximum step ΔTLmax and the maximum step ΔTSmax may be set to have the relationship that $\Delta TSmax \leqq \Delta TLmax$. Moreover, the thickness T at an arbitrary position of the second region 3*e*2 is set within the range of, e.g., $0.5 \leqq T/T_R \leqq 1$ with respect to the thickness $T_R$ at the boundary with the stepped portion 3*e*3.

Additionally, in this embodiment, the stepped portion 3*e*3 is made of two curved surfaces 3*e*31 and 3*e*32. The radius of curvature R1 of the curved surface 3*e*31 on the side of the first region 3*e*1 and the radius of curvature R2 of the curved surface 3*e*32 on the side of the second region 3*e*2 are set to satisfy the relationships that $1 \leqq R2/R1 \leqq 3$ and $2 \leqq R1/\Delta T \leqq 20$. The stepped portion 3*e*3 is an area of point of change in thickness land thus is prone to the concentration of vacuum stress. Forming this portion out of two curved surfaces 3*e*31 and 3*e*32 can effectively relieve the stress concentration. In particular, when the radii of curvature R1 and R2 of these curved surfaces 3*e*31 and 3*e*32 are set to satisfy the foregoing relationships, it is possible to avoid cracks of the funnel 3 resulting from defective molding or flaw occurrence while relieving the stress concentration.

Incidentally, the stepped portion 3*e*3 may be made of a combination of three or more curved surfaces. In this case, the radius of curvature R1 of a curved surface the closest to the first region 3*e*1 and the radius of curvature R2 of a curved surface the closest to the second region 3*e*2 preferably satisfy the relationships mentioned above. Moreover, the stepped portion 3*e*3 may be made of a single curved surface or straight surface. Otherwise, it may be made of an appropriate combination of one or more curved surfaces and straight surfaces.

Furthermore, in this embodiment, the external surface of the first region 3e1 forms an inclined surface spreading out toward the mold match line 3c2. An angle A formed between the external surface and a plane Z' parallel to the tube axis Z is set within the range of $3° \leqq A \leqq 15°$. This can enhance the releasability from the molds in press-molding the funnel 3, thereby preventing the external surface of the first region 3e1 from scratches with the molds and making the effect of the provision of the first region 3e1 practically effective.

Figure 8:
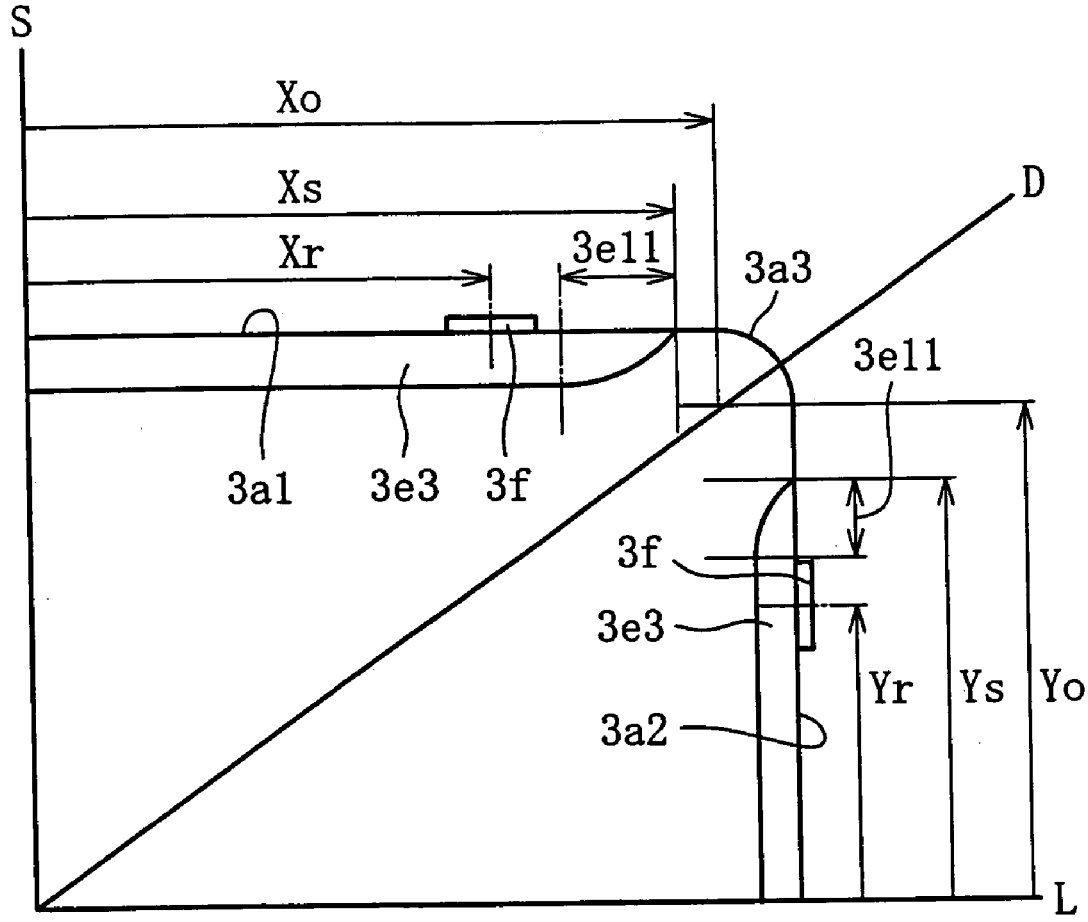
FIG. 8 is a diagram conceptually showing the ranges of existence of the stepped portion in a 90°-range quadrant including a minor axis and a major axis.

FIG. 8 conceptually shows the ranges of existence of the stepped portion 3e3 in a 90°-range quadrant including the minor axis S and the major axis L.

The larger opening portion 3a is typically composed of three arcs, an arc for making the major side 3a1, an arc for making the minor side 3a2, and an arc for making the corner 3a3. The stepped portion 3e3 is arranged within the range extending from the minor axis S to a distance Xs along the major side 3a1 and in the range extending from the major axis L to a distance Ys along the minor side 3a2. The stepped portion 3e3 lies within the ranges excluding the corners 3a3. The distance Xs is set within the range of $Xr/2 \leqq Xs \leqq Xo$ and the distance Ys the range of $Yr/2 \leqq Ys \leqq Yo$, where Xo is the distance from the minor axis S to the boundary between the major side 3a1 and the corner 3a3, Yo is the distance from the major axis L to the boundary between the minor side 3a2 and the corner 3a3, Xr is the distance from the minor axis S to the center of the alignment reference portion 3f on the major side 3a1, and Yr is the distance from the major axis L to the center of the alignment reference portion 3f on the minor side 3a2.

To relieve sudden changes in thickness at the end points of the stepped portion 3e3, the stepped portion 3e3 is also provided with connecting portions 3e11 which lead to the position of distance Xs (end point) and the position of distance Ys (end point), respectively, while gradually decreasing in step ΔT.

Moreover, the second region 3e2 and the corners 3a3, as well as the second region 3e2 and the yoke portion 3d, are continuous to each other without any step, respectively. Although the boundaries of these portions may not be evident in appearance, the range of the second region 3e2 are schematically shown as in the double-dashed lines in FIG. 3. Incidentally, the first region 3e1 and the corners 3a3 are also continuous without any step.

Figure 9:
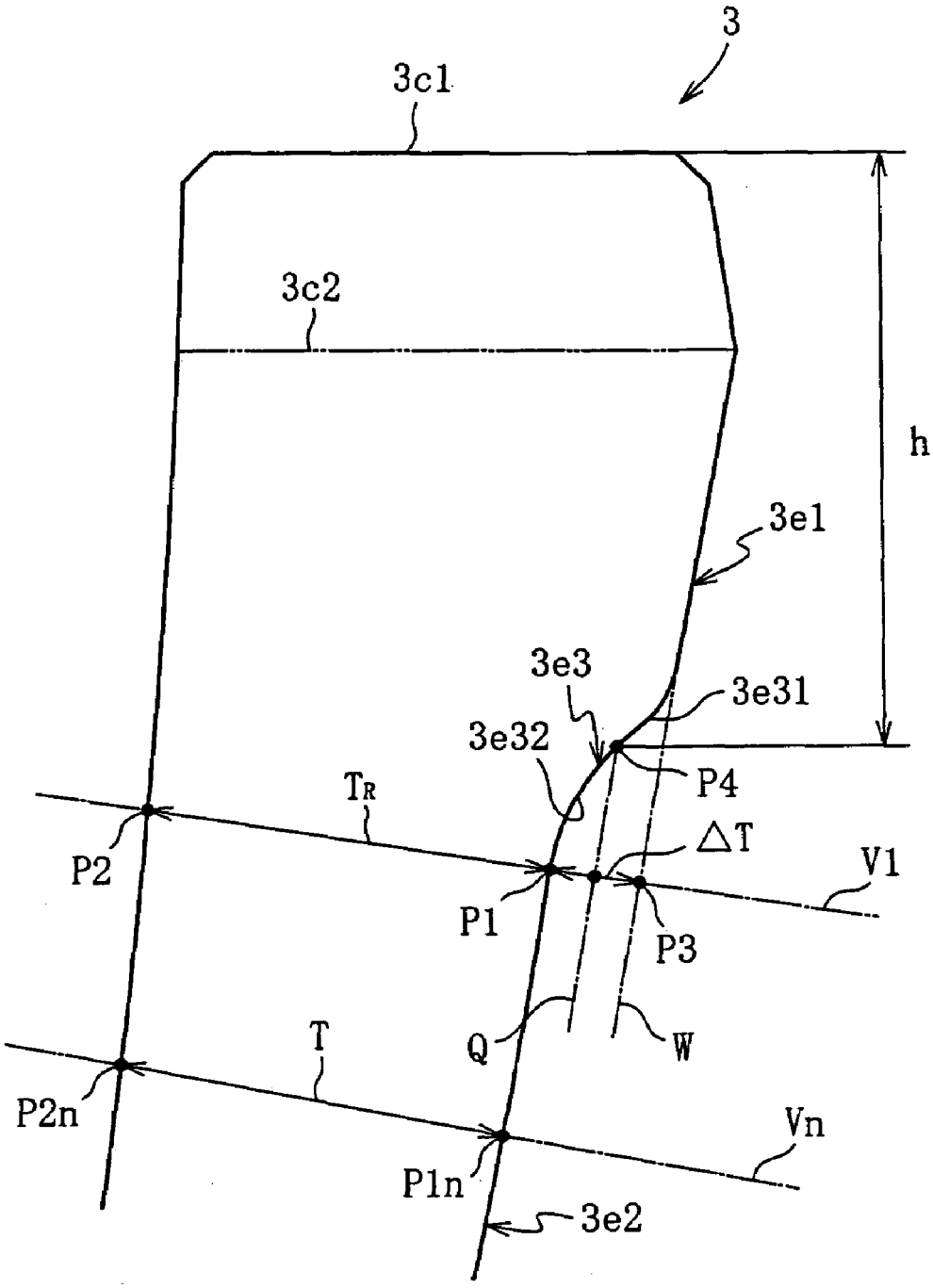
FIG. 9 is an enlarged partial sectional view showing the vicinity of the larger opening portion of the funnel.

The dimensions h, ΔT, $T_R$, and T mentioned above are determined according to the references shown in FIG. 9 respectively. Initially, in a cross section parallel to the tube axis Z, a normal V1 to the external surface passing through a boundary point P1 between the stepped portion 3e3 and the second region 3e2 (in the example shown in the same figure, a boundary between the curved surface 3e32 and the second region 3e2) is determined. When the intersecting point of the normal V1 with the internal surface is P2 and the intersecting point of the normal V1 with an extension line W of the external surface of the first region 3e1 is P3, $T_R$ is the length of the line segment P1–P2 and ΔT is the length of the line segment P1–P3. Next, a point P4 at which a line Q passing through the midpoint of the line segment P1–P3 (the position of ΔT/2) and being perpendicular to the normal V1 intersects the stepped portion 3e3 is determined. The length of a line segment that is drawn down from the position of the seal edge surface 3c1 to the position of the intersection P4 in a direction parallel to the tube axis Z is h. T is the length of a line segment P1*n*–P2*n*, where P1*n* and P2*n* are the intersecting points of a normal Vn to the external surface at an arbitrary position of the second region 3e2 with the internal surface and the external surface.

Figure 10:
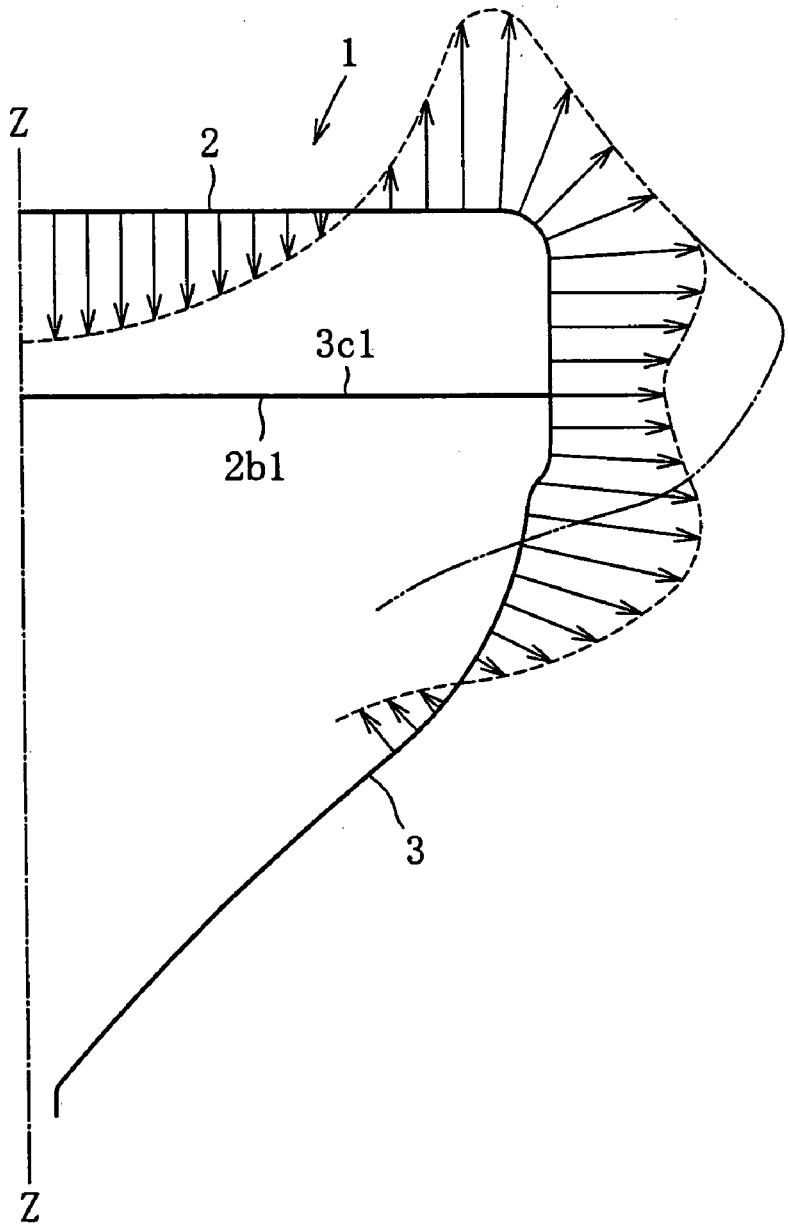
FIG. 10 is a diagram showing the distribution of vacuum stress acting on the glass bulb according to the embodiment.
Figure 15A:
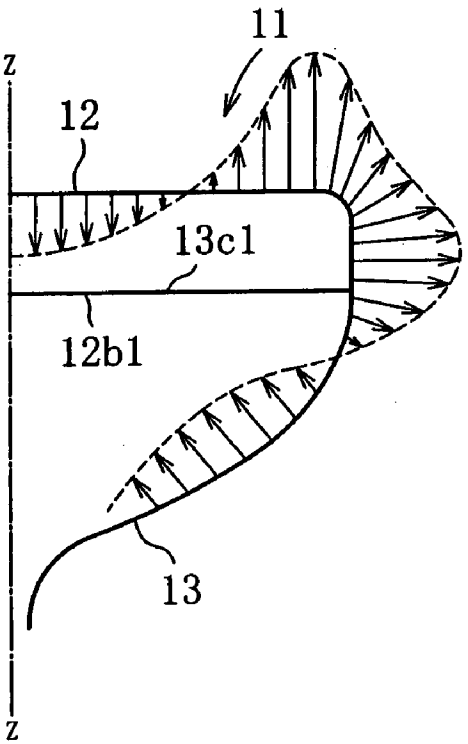
FIG. 15 is a diagram showing the distributions of vacuum stress acting on the conventional glass bulb.
Figure 15B:
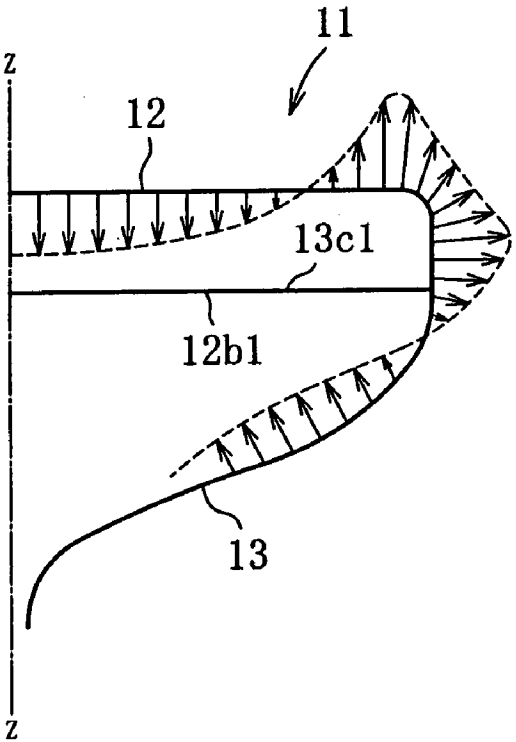
Figure 15C:
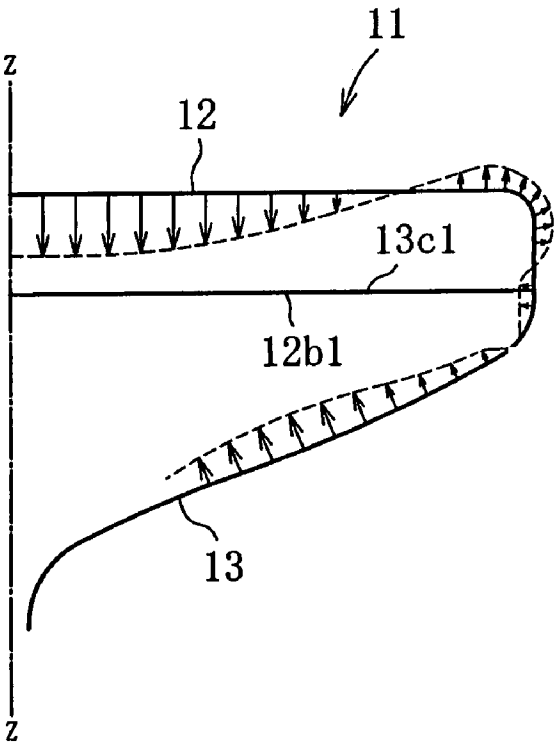

The glass bulb 1 for a cathode-ray tube in this embodiment, constituted by joining the panel 2 and the funnel 3 as aforesaid to each other, is used as a vacuum vessel after installing an electron gun in the neck portion 4 and then evacuating inside thereof (the internal pressure after the evacuation is on the order of, e.g., $10^{-8}$ Torr). FIG. 10 schematically shows the distribution of vacuum stress in the minor-axis section of the glass bulb 1 for a cathode-ray tube in this embodiment. In the diagram, the regions indicated with inward arrows represent regions undergoing compressive stress, and the region indicated with outward arrows regions undergoing tensile stress. Besides, the double-dashed chain line indicates the distribution of vacuum stress in a minor-axis section of the conventional glass bulb 11 for a cathode-ray tube {FIG. 15(*a*)}. As shown in the diagram, the tensile vacuum stress in the conventional glass bulb 11 for a cathode-ray tube peaks in the vicinity of the joint portion between the panel and the funnel (the double-dashed chain line). In the glass bulb 1 for a cathode-ray tube in this embodiment, the peak of the tensile vacuum stress shifts toward the side of the smaller opening portion 3b (toward the side of the neck tube 4) from the vicinity of the joint portion between the panel 2 and the funnel 3. The reason for this seems that the body portion 3e of the funnel 3 is provided with the first region 3e1 of relatively greater thickness on the side of the seal edge portion 3c and the second region 3e2 of relatively smaller thickness on the side of the smaller opening portion 3b (on the side of the neck tube 4). Thereby, the tensile vacuum stress in the vicinity of the joint portion may be dispersed due to elastic ductility of the second region 3e2 being thinned moderately, and thus increases in the degree of load on the side of the second region 3e2. Incidentally, though omitted from the drawings, the distribution of vacuum stress in the major-axis section also shows generally the same tendency as mentioned above (the magnitude of the tensile vacuum stress is, however, smaller than in the minor-axis section).

Figure 13:
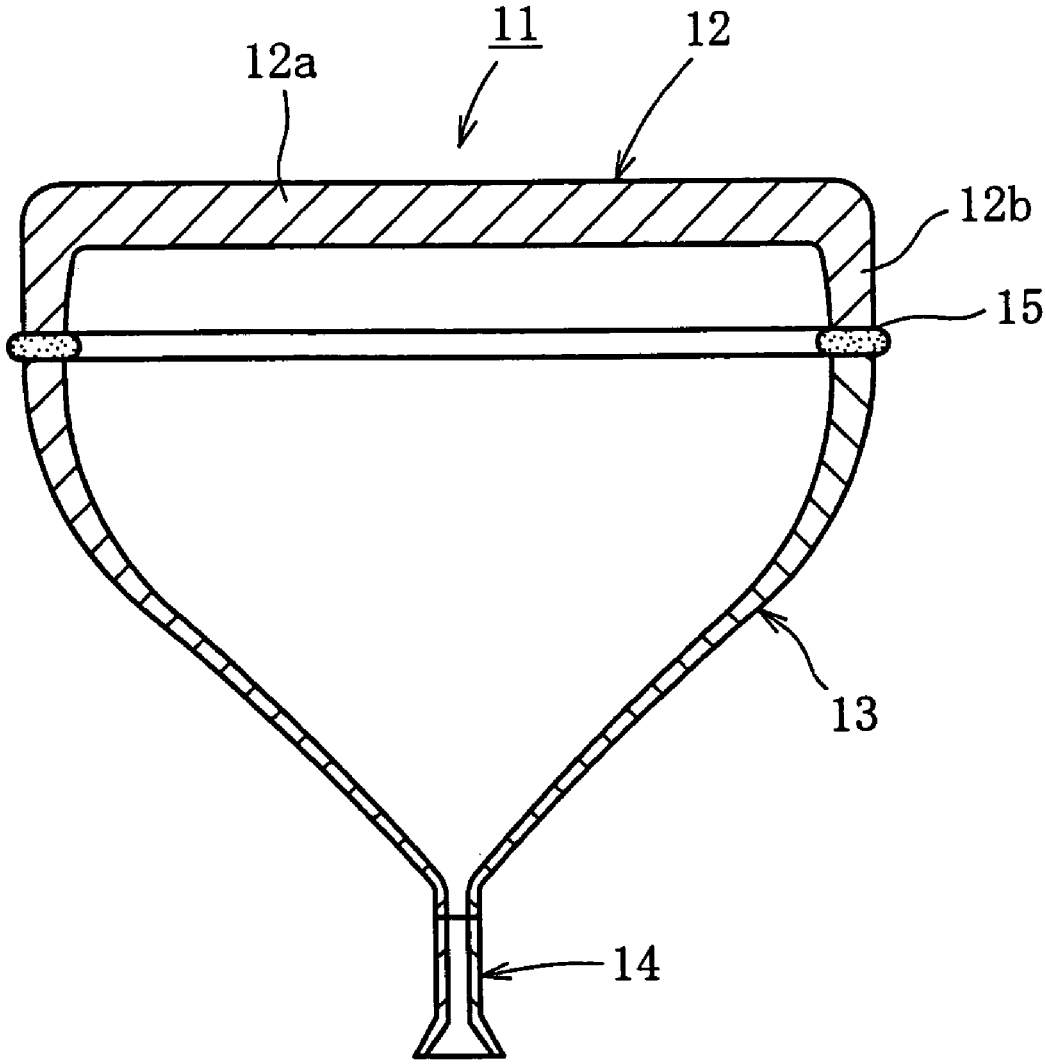
FIG. 13 (PRIOR ART)
FIG. 13 is a sectional view of a conventional glass bulb, taken along a direction parallel to the tube axis.
Figure 14:
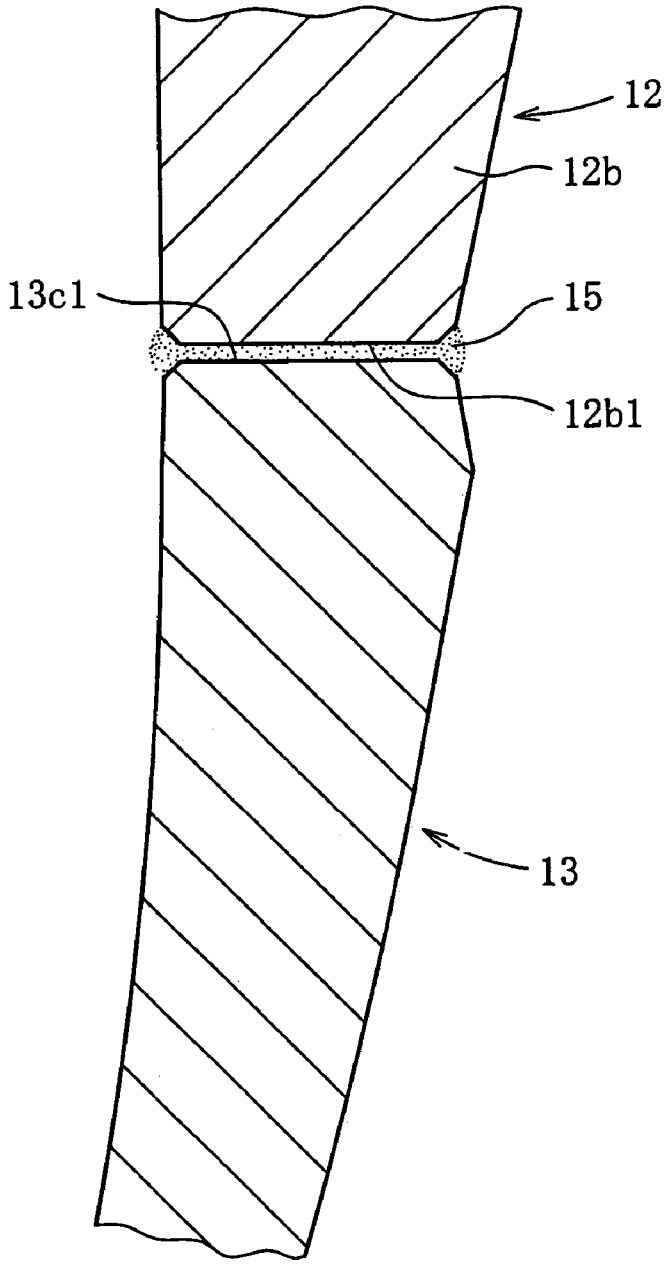
FIG. 14 (PRIOR ART)
FIG. 14 is an enlarged partial sectional view showing the vicinity of a panel-funnel joint in the conventional glass bulb.

The configuration described above relieves the tensile vacuum stress acting on the joint portion as the weak point in strength. As a result, the glass bulb 1 for a cathode-ray tube further improves in the strength against vacuum fracture. In addition, the provision of the second region 3e2 having a relatively smaller thickness allows a weight reduction of the glass funnel 3 for a cathode-ray tube, furthermore the glass bulb 1 for a cathode-ray tube. Consequently, the glass funnel 3 for a cathode-ray tube of this embodiment, furthermore the glass bulb 1 for a cathode-ray tube of this embodiment, provides the contradictory characteristics of strength and light weight in favorable balance. Incidentally, in FIGS. 4–6, the external surface of the conventional funnel 13 in FIGS. 13 and 14 is shown by the dashed lines, schematically showing how the second region 3e2 of the funnel 3 of this embodiment is thinned.

In addition, the first region 3e1 and the second region 3e2 are arranged within the range excluding the corners 3a3 so that the stepped portion 3e3 is not formed at the corners 3a3. In molding the funnel 3, the seal edge portion 3c is thus be smoothly filled with the molten glass at the corners 3a3, thereby avoiding such problems as minute cracks in the glass and an increase in the pressing force. Hence, the funnel 3 has excellent moldability. In particular, in this embodiment, the second region 3e2 and the corners 3a3 are rendered continuous without any step and the stepped portion 3e3 is further provided with the connecting portions 3e11. This smoothes the flow of molten glass from the minor-axis sides and the major-axis sides toward the diagonal-axis directions, thereby contributing to improved moldability.

Figure 11:
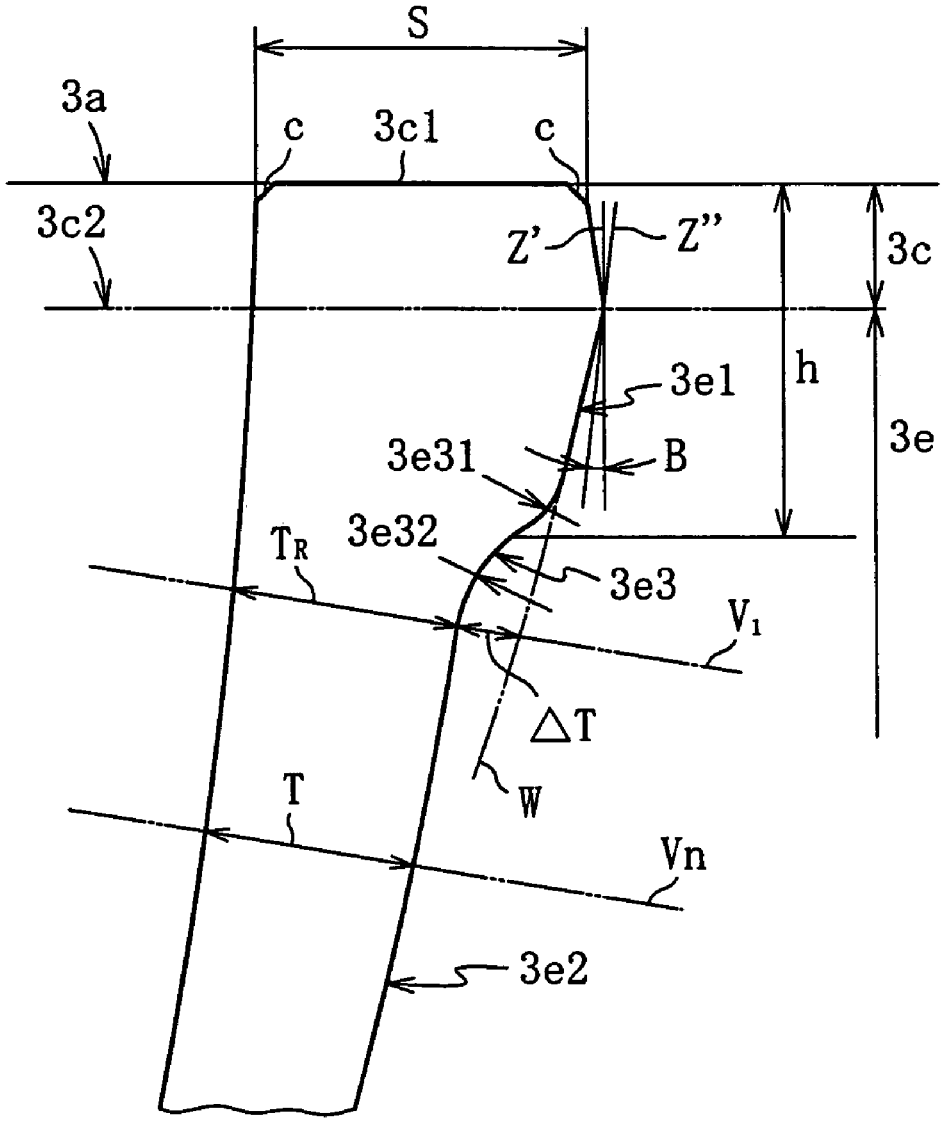
FIG. 11 is an enlarged partial sectional view showing the vicinity of the larger opening portion of a funnel according to another embodiment.
Figure 12:
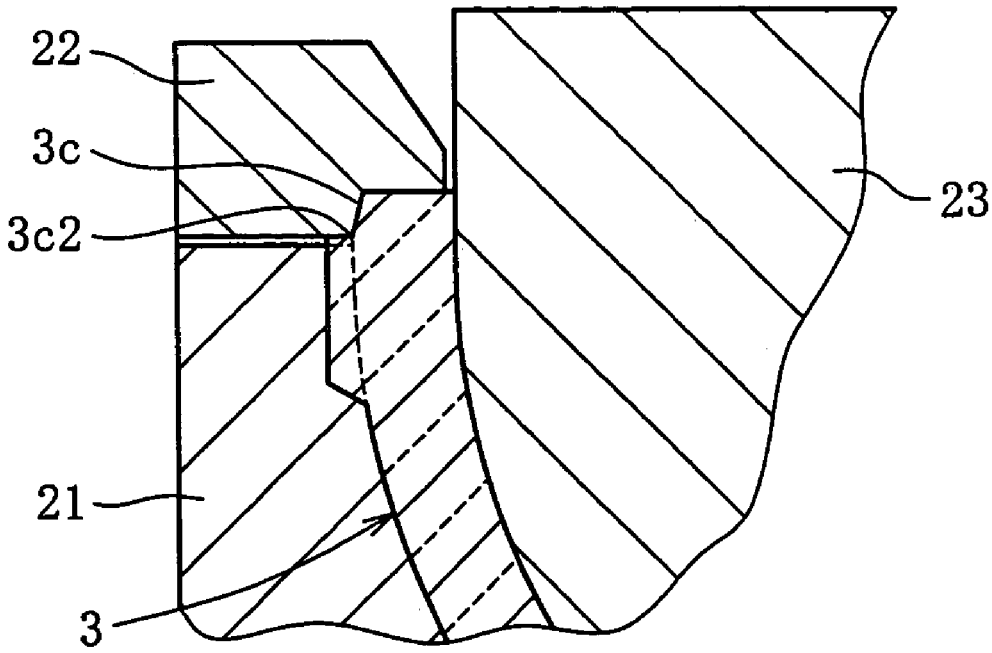
FIG. 12 is a diagram showing the funnel under molding.

Another embodiment shown in FIG. 11 is one in which the external surface of the first region 3*e*1 of the funnel 3 forms a curved surface (arcuate surface) spreading out toward the mold match line 3*c*2. An angle B formed between a tangent plane Z" of the external surface across the mold match line 3*c*2 and a plane Z' parallel to the tube axis Z is set within the range of $3° \leqq B \leqq 15°$. This can enhance the releasability from the molds in press-molding the funnel 3, thereby preventing the external surface of the first region 3*e*1 from scratches with the molds and making the effect of the provision of the first region 3*e*1 practically effective.

Panels having the configuration shown in FIG. 2 (flat panels) and funnels having the configuration shown in FIGS. 3–9 (with the external surfaces of the first regions forming curved surfaces as shown in FIG. 11) were joined with seal glass for sealing to fabricate glass bulbs for a cathode-ray tube having the configuration shown in FIG. 1 (embodiments 1 and 2, comparative example). A comparative test was conducted with the conventional glass bulb for a cathode-ray tube (conventional example) shown in FIGS. 13 and 14. The embodiments, comparative example, and conventional example had a maximum outside diameter of 76 cm on the diagonal axis, a bulb deflection angle of 102°, an aspect ratio of 16:9, and a neck outside diameter of 29.1 mm each, with a panel of the following specifications. Table 1 shows the results of the comparative test.

[Panel Specifications]

Panel center thickness: 13.5 mm

Radius of curvature of external surface (in minor-axis direction): 100000 mm

Radius of curvature of external surface (in major-axis direction): 100000 mm

Radius of curvature of external surface (in diagonal-axis direction): 100000 mm

Radius of curvature of internal surface (in minor-axis direction): 1480 mm

Radius of curvature of internal surface (in major-axis direction): 6240 mm

Radius of curvature of internal surface (in diagonal-axis direction): 5650 mm

[Range of Stepped portion]

Embodiment 1: Xs=Xo, Ys=Yo

Embodiment 2: Xs=Xr/2, Ys=Yr/2

Comparative example: the entire circumference of the body portion (the first region and second region being formed all around the body portion)

TABLE 1

| | Comparative Test (Unit of dimension: mm) | | | |
|---|---|---|---|---|
| | Embodiment 1 | Embodiment 2 | Comparative example | Conventional example |
| h | 14.2 | 14.2 | 14.2 | — |
| S | 12.0 | 12.0 | 12.0 | 12.0 |
| ΔT | 1.7 | 1.7 | 1.7 | — |
| $T_R$ | 10.4 | 10.4 | 10.4 | — |
| T | 6.3 | 6.3 | 6.3 | 7.4 |
| Tensile vacuum stress (at Joint portion) (MPa) | 7.66 | 7.66 | 7.66 | 8.39 |

TABLE 1-continued

| | Comparative Test (Unit of dimension: mm) | | | |
|---|---|---|---|---|
| | Embodiment 1 | Embodiment 2 | Comparative example | Conventional example |
| Ratio of Weight (%) | 89 | 95 | 89 | 100 |
| Moldability | ○ | ○ | Δ | ⊙ |

h: Dimension of first region in the direction parallel to tube axis
S: Thickness of seal edge surface
ΔT: Step
$T_R$: Thickness at boundary with stepped portion
T: Minimum thickness of body portion

[Evaluations on Comparative Test]

(Embodiments 1 and 2)

As compared to the conventional example, there were observed the effect of relieving the tensile vacuum stress at the joint portion and the effect of weight reduction. The funnels also had excellent moldability. In addition, with an indication of a tensile vacuum stress value suppressed to or below 8.4 MPa as a reference of mechanical strength required of this type of glass bulb, both the embodiments 1 and 2 showed tensile vacuum stress value (7.66 MPa) below the reference value (8.4 MPa).

COMPARATIVE EXAMPLE

As compared to the conventional example, there were observed the effect of relieving the tensile vacuum stress at the joint portion and the effect of weight reduction, whereas the funnel was not sufficiently in moldability.

As is evident from the results of the comparative test, the funnels of the embodiments provide the contradictory characteristics of strength and light weight in favorable balance, and are excellent in moldability as well, when compared to the comparative example and the conventional example.

The invention claimed is:

1. A glass funnel for a cathode-ray tube, having a shape of a funnel with a rectangular larger opening portion at one end and a smaller opening portion at the other end, said larger opening portion being composed of major sides across a minor axis, minor sides across a major axis, and corners on a diagonal axis, the corners continuing between said major sides and said minor sides, the glass funnel comprising a seal edge portion extending from a seal edge surface of said larger opening portion to a mold match line, a yoke portion to be equipped with a deflection yoke, said yoke portion being arranged at a side of said smaller opening portion, and a body portion for continuing between said mold match line and said yoke portion, wherein:

said seal edge surface has a thickness almost equal to a thickness of a seal edge surface of a glass panel for a cathode-ray tube to be joined thereto;

said body portion, within a range excluding said corners, has a first region of predetermined dimension measured from said seal edge surface in a direction parallel to a tube axis and a second region excluding said first portion;

when constituting a cathode-ray tube, said first region falls on a region to undergo tensile vacuum stress resulting from a vacuum pressure in said cathode-ray tube;

said second region has a thickness smaller than a thickness of said first region, so that a boundary portion between said first region and said second region forms a stepped portion on an external surface of said body portion.

2. The glass funnel for a cathode-ray tube according to claim 1, wherein said second region and said corners are continuous without any step.

3. The glass funnel for a cathode-ray tube according to claim 1 wherein: said stepped portion, in a 90°-range quadrant including said minor axis and said major axis, lies within a range from said minor axis to a distance Xs along said major side and a range from said major axis to a distance Ys along said minor side; and said distance Xs satisfies $Xr/2 \leqq Xs \leqq Xo$ and said distance Ys satisfies $Yr/2 \leqq Ys \leqq Yo$, where Xo is a distance from said minor axis to a boundary between said major side and said corner, Yo is a distance from said major axis to a boundary between said minor side and said corner, Xr is a distance from said minor axis to the center of an alignment reference portion on said major side, and Yr is a distance from said major axis to the center of an alignment reference portion on said minor side.

4. The glass funnel for a cathode-ray tube according to claim 1, wherein said stepped portion has a maximum step $\Delta Tmax$ of $0.06 \leqq \Delta Tmax/S \leqq 0.3$ with respect to the thickness S of said seal edge surface.

5. The glass funnel for a cathode-ray tube according to claim 1, wherein the maximum step $\Delta TLmax$ of said stepped portion on said major side and the maximum step $\Delta TSmax$ of said stepped portion on said minor side have a relationship that $\Delta Tsmax \leqq \Delta TLmax$.

6. The glass funnel for a cathode-ray tube according to claim 1, wherein said stepped portion has connecting portions leading to a position of a distance Xs and a position of a distance Ys, respectively, while gradually decreasing in step.

7. A glass funnel for a cathode-ray tube, having a shape of a funnel with a rectangular larger opening portion at one end and a smaller opening portion at the other end, said larger opening portion being composed of major sides across a minor axis, minor sides across a major axis, and corners on a diagonal axis, corners continuing between said major sides and said minor sides, the glass funnel comprising a seal edge portion extending from a seal edge surface of said larger opening portion to a mold match line, a yoke portion to be equipped with a deflection yoke, said yoke portion being arranged at a side of said smaller opening portion, and a body portion for continuing between said mold match line and said yoke portion, wherein:

said seal edge surface has a thickness almost equal to a thickness of a seal edge surface of a glass panel for a cathode-ray tube to be joined thereto;

said body portion has a first region of predetermined dimension measured from said seal edge surface in a direction parallel to a tube axis and a second portion excluding said first portion;

when constituting a cathode-ray tube, said first region falls on a region to undergo tensile vacuum stress resulting from a vacuum pressure in said cathode-ray tube;

said second region has a thickness smaller than a thickness of said first region, so that a boundary portion between said first region and said second region forms a stepped portion on an external surface of said body portion; and a maximum step $\Delta TLmax$ of said stepped portion on said major side and a maximum step $\Delta TSmax$ of said stepped portion on said minor side have a relationship that $\Delta TSmax \leqq \Delta TLmax$.

8. A glass bulb for a cathode-ray tube comprising:

a glass panel for a cathode-ray tube including a face portion having a substantially flat external surface, a skirt portion extending from the periphery of said face portion, and a seal edge surface arranged on an end surface of said skirt portion;

a glass funnel having a shape of a funnel with a rectangular larger opening portion a one end and a smaller opening portion at the other end, said larger opening portion being composed of major sides across a minor axis, minor sides across a major axis, and corners on a diagonal axis, the corners continuing between said major sides and said minor sides, the glass funnel comprising a seal edge portion extending from a seal edge surface of said larger opening portion to a mold match line, a yoke portion to be equipped with a deflection yoke, said yoke portion being arranged at a side of said smaller opening portion, and a body portion for continuing between said mold match line and said yoke portion, wherein:

said seal edge surface has a thickness almost equal to a thickness of a seal edge surface of a glass panel for a cathode-ray tube to be joined thereto;

said body portion, within a range excluding said corners, has a first region of predetermined dimension measured from said seal edge surface in a direction parallel to a tube axis and a second region excluding said first portion;

when constituting a cathode-ray tube, said first region falls on a region to undergo tensile vacuum stress resulting from a vacuum pressure in said cathode-ray tube; said second region has a thickness smaller than a thickness of said first region, so that a boundary portion between said first region and said second region forms a stepped portion on an external surface of said body portion; and a neck portion to be equipped with an electron gun, said neck portion being joined to said smaller opening portion of the glass funnel for a cathode-ray tube, wherein said seal edge surface of said glass panel for a cathode-ray tube and said seal edge surface of the glass funnel for a cathode-ray tube are joined to each other.

9. The glass bulb for a cathode-ray tube according to claim 8, wherein said second region and said corners of the glass funnel are continuous without any step.

10. The glass bulb for a cathode-ray tube according to claim 8, wherein:

said stepped portion of the glass funnel, in a 90°-range quadrant including said minor axis and said major axis, lies within a range from said minor axis to a distance Xs along said major side and a range from said major axis to a distance Ys along said minor said; and said distance Xs of the glass funnel satisfies $Xr/2 \leqq Xs \leqq Xo$ and said distance Ys satisfies $Yr/2 \leqq Ys \leqq Yo$, where Xo is a distance from said minor axis to a boundary between said major side and said corner, Yo is a distance from said major axis to a boundary between said minor side and said corner, Xr is a distance from said minor axis to the center of an alignment reference portion on said major side, and Yr is a distance from said major axis to the center of an alignment reference portion on said minor side.

11. The glass bulb for a cathode-ray tube according to claim 8, wherein said stepped portion of the glass funnel has a maximum step $\Delta Tmax$ of $0.06 \leqq Tmax/S \leqq 0.3$ with respect to the thickness S of said seal edge surface.

12. The glass bulb for a cathode-ray tube according to claim 8, wherein a maximum step $\Delta TLmax$ of said stepped portion on said major side and a maximum step $\Delta TSmax$ of said stepped portion on said minor side of the glass funnel have a relationship that $\Delta TSmax \leqq \Delta TLmax$.

13. The glass bulb for a cathode-ray tube according to claim 8, wherein said stepped portion of the glass funnel has connecting portions leading to a position of a distance Xs and a position of a distance Ys, respectively, while gradually decreasing in step.

14. A glass bulb for a cathode-ray tube comprising:

a glass panel for a cathode-ray tube including a face portion having a substantially flat external surface, a skirt portion extending from the periphery of said face portion, and a seal edge surface arranged on an end surface of said skirt portion;

a glass funnel for a cathode-ray tube, having a shape of a funnel with a rectangular larger opening portion at one end and a smaller opening portion at the other end, said larger opening portion being composed of major sides across a minor axis, minor sides across a major axis, and corners on a diagonal axis, corners continuing between said major sides and said minor sides, the glass funnel comprising a seal edge portion extending from a seal edge surface of said larger opening portion to a mold match line, a yoke portion to be equipped with a deflection yoke, said yoke portion being arranged at a side of said smaller opening portion, and a body portion for continuing between said mold match line and said yoke portion, wherein:

said seal edge surface has a thickness almost equal to a thickness of a seal edge surface of a glass panel for a cathode-ray tube to be joined thereto;

said body portion has a first region of predetermined dimension measured from said seal edge surface in a direction parallel to a tube axis and a second portion excluding said first portion;

when constituting a cathode-ray tube, said first region falls on a region to undergo tensile vacuum stress resulting from a vacuum pressure in said cathode-ray tube;

said second region has a thickness smaller than a thickness of said first region, so that a boundary portion between said first region and said second region forms a stepped portion on an external surface of said body portion; and a maximum step $\Delta TLmax$ of said stepped portion on said major side and a maximum step $\Delta TSmax$ of said stepped portion on said minor side have a relationship that $\Delta TSmax \leqq \Delta TLmax$; and a neck portion to be equipped with an electron gun, said neck portion being joined to said smaller opening portion of the glass funnel for a cathode-ray tube, wherein said seal edge surface of said glass panel for a cathode-ray tube and said seal edge surface of the glass funnel for a cathode-ray tube a rejoined to each other.

* * * * *